US006811218B2

(12) United States Patent
Deimen et al.

(10) Patent No.: US 6,811,218 B2
(45) Date of Patent: Nov. 2, 2004

(54) CHAIR WITH CONFORMING SEAT

(75) Inventors: Michael L. Deimen, Holland, IN (US); Derek Schweikarth, Jasper, IN (US); Stephen D. Hatcher, Jasper, IN (US); Joseph G. Hasenour, St. Anthony, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 10/315,590

(22) Filed: Dec. 10, 2002

(65) Prior Publication Data

US 2003/0137171 A1 Jul. 24, 2003

Related U.S. Application Data

(60) Provisional application No. 60/340,570, filed on Dec. 14, 2001.

(51) Int. Cl.[7] ..... A47C 3/025

(52) U.S. Cl. ..... 297/284.1; 297/316; 297/452.25; 297/195.11; 297/320; 297/452.21

(58) Field of Search ..... 297/452.21, 452.23, 297/316, 452.24, 452.25, 300.1, 321, 350.2, 195.11; 5/654, 653

(56) References Cited

U.S. PATENT DOCUMENTS

| | | | | | |
|---|---|---|---|---|---|
| 1,938,879 | A | | 12/1933 | Waggoner et al. | 155/184 |
| 1,961,641 | A | | 6/1934 | Ollis | 155/178 |
| 2,285,925 | A | | 6/1942 | Handy | 155/51 |
| 3,463,547 | A | | 8/1969 | Brennan et al. | 297/459 |
| 4,047,757 | A | | 9/1977 | Eames et al. | 297/230 |
| 4,132,228 | A | | 1/1979 | Green | 128/33 |
| 4,249,774 | A | * | 2/1981 | Andreasson | 297/311 |
| 4,418,958 | A | | 12/1983 | Watkin | 297/457 |
| 4,529,247 | A | | 7/1985 | Stumpf et al. | 297/301 |
| 4,552,404 | A | | 11/1985 | Congleton | 297/330 |
| 4,566,733 | A | | 1/1986 | Compton | 297/284 |
| 4,607,882 | A | | 8/1986 | Opsvik | 297/195 |
| 4,660,887 | A | | 4/1987 | Fleming et al. | 297/445 |
| 4,690,459 | A | | 9/1987 | Ullman | 297/458 |
| 4,883,320 | A | | 11/1989 | Izumida et al. | 297/452 |
| 5,015,038 | A | | 5/1991 | Mrotz, III | 297/457 |
| 5,236,247 | A | | 8/1993 | Hewko | 297/452.1 |
| 5,352,022 | A | | 10/1994 | Knoblock | 297/452.15 |
| 5,385,388 | A | | 1/1995 | Faiks et al. | 297/301 |
| 5,439,270 | A | | 8/1995 | Owen | 297/452.27 |
| 5,447,358 | A | | 9/1995 | Corlett | 297/344.18 |
| 5,457,833 | A | * | 10/1995 | Jay | 5/654 |
| 5,489,145 | A | | 2/1996 | Van Hekken | 297/452.57 |
| 5,499,413 | A | | 3/1996 | Van Hekken | 5/464 |
| 5,547,253 | A | | 8/1996 | Schwartz et al. | 297/338 |
| 5,575,534 | A | | 11/1996 | Yu | 297/452.21 |
| 5,577,811 | A | | 11/1996 | Ogg | 297/452.15 |
| 5,681,092 | A | | 10/1997 | Hanson et al. | 297/452.41 |
| 5,716,099 | A | | 2/1998 | McDiarmid | 297/302.1 |
| 5,791,736 | A | * | 8/1998 | Herbert | 297/452.21 |
| 5,957,534 | A | | 9/1999 | Wilkerson et al. | 297/316 |
| 5,997,094 | A | | 12/1999 | Cvek | 297/452.15 |
| 6,033,016 | A | * | 3/2000 | Haywood | 297/195.11 |
| 6,086,153 | A | | 7/2000 | Heidmann et al. | 297/300.1 |

(List continued on next page.)

FOREIGN PATENT DOCUMENTS

| | | |
|---|---|---|
| DE | 26 30 267 | 1/1978 |
| WO | WO 02/07567 | 1/2002 |

*Primary Examiner*—Peter M. Cuomo
*Assistant Examiner*—Erika Garrett
(74) *Attorney, Agent, or Firm*—Baker & Daniels

(57) ABSTRACT

A task chair including a seat support structure, and a seat supported by the seat support structure and having a seating surface which may ergonomically conform to a seated user. The seating surface includes rigid and flexible portions connected to one another, the flexible portions allowing resilient flexing of the seating surface to create conformance zones which dynamically support a seated user in an ergonomic manner.

33 Claims, 10 Drawing Sheets

U.S. PATENT DOCUMENTS

| | | | | | |
|---|---|---|---|---|---|
| 6,123,390 | A | * | 9/2000 | Greenwald | 297/452.32 |
| 6,125,521 | A | | 10/2000 | Stumpf et al. | 29/448 |
| 6,142,566 | A | | 11/2000 | Ritch et al. | 297/239 |
| 6,142,573 | A | | 11/2000 | Harding et al. | 297/452.25 |
| D436,456 | S | | 1/2001 | Neil | D6/366 |
| 6,193,309 | B1 | | 2/2001 | Gootter et al. | 297/202 |
| D449,172 | S | | 10/2001 | Van De Riet et al. | D6/366 |
| 6,431,649 | B1 | * | 8/2002 | Hensel | 297/300.2 |
| 2002/0043871 | A1 | | 4/2002 | Prine et al. | 297/452.55 |

* cited by examiner

CHAIR WITH CONFORMING SEAT

CROSS REFERENCE TO RELATED APPLICATIONS

This application claims the benefit under Title 35, U.S.C. §119(e) of U.S. Provisional Patent Application Ser. No. 60/340,570, entitled CHAIR WITH CONFORMING SEAT, filed on Dec. 14, 2001.

BACKGROUND OF THE INVENTION

1. Field of the Invention

The present invention relates to chairs, and in particular, to a task chair for supporting a seated user thereon in an ergonomic manner.

2. Description of the Related Art

Task chairs are commonly used by persons while working in a seated position in an office or other occupational environment. Typically, such chairs include a caster wheel assembly for rolling movement over a floor surface, as well as a number of manual adjustment features to allow the user to adjust the shape or movement characteristics of the chair to a desired configuration.

Many task chairs include a rigid seat pan and a rigid backrest pan, the seat pan and backrest pan including a layer of foam padding thereon which is covered by a decorative upholstery material. Although the foam padding provides some cushioning support for a seated user, the rigid and noncompliant seat pan and backrest pan may become uncomfortable to the user, especially if the user is seated at the chair for an extended period of time. In this connection, if the layer of foam padding is too thin, the user's ischium or tail bone may abut the rigid seat pan to cause discomfort, and, if the layer of foam padding is too thick, the seat may not provide a firm overall support for the user.

Other known task chairs include seats having a relatively rigid outer frame supporting a mesh or webbing material thereacross which is flexible to conform to the seated user. However, such mesh or web material may catch, wear, or snag a user's clothing when the user shifts positions in the chair or stands up from the chair. Also, such mesh or webbing material is somewhat frictionless, such that when a user uses the forward tilt mechanism of the chair, the user experiences the sensation of falling forwardly or sliding out of the chair. Similarly, when the user moves to a reclined posture in such chairs, the user tends to slide forwardly out of the chair, and the lumbar region of the user's back disengages from the lower portion of the backrest.

What is needed is a task chair which conformingly and comfortably supports a seated user, and which is an improvement over the foregoing.

SUMMARY OF THE INVENTION

The present invention provides a task chair including a seat support structure, and a seat supported by the seat support structure having a seating surface which may ergonomically conform to a seated user. The seating surface includes rigid and flexible portions connected to one another, the flexible portions allowing resilient flexing of the seating surface to create conformance zones which dynamically support a seated user in an ergonomic manner.

The rigid portions of the seat may be formed of wood, metal, or a rigid plastic, for example, and the flexible portions may be formed of a pliable urethane or a silicone material, for example. The rigid and flexible portions may be connected to one another by insert molding the flexible portions to the rigid portions, or by mechanically or adhesively joining the flexible portions to the rigid portions. The particular shape, size, and relative configurations of the rigid portions and the flexible portions may be selectively varied to provide seating surfaces having desired conformance and support characteristics for the seated user.

The seat support structure may include a seat flex lockout mechanism movable between a first position and a second position, wherein flexing of the seating surface is prevented in the first position and is allowed in the second position. Additionally, the seat support structure may include a mechanism which allows the seat to be moved between high, middle, and low positions.

Advantageously, the present task chair includes a seating surface having rigid portions which provide a relatively firm support to a seated user, and flexible portions which facilitate movement of the flexible and rigid portions of the seating surface, and which provide support to the seated user in selected zones of the seating surface. Additionally, the flexible portions permit the seating surface to resiliently flex from a relatively planar shape to a saddle or saddle-like shape which conforms to the seated user. Further, the saddle-like shape supports the seated user, preventing the user from experiencing the sensation of falling or sliding out of the chair.

In one form thereof, the present invention provides a chair, including seat support structure; and a seat supported by the seat support structure, the seat including a flexible portion and at least one rigid portion, the seat resiliently movable between a first position in which the seat has a substantially flattened shape, and a second position in which opposite sides of a front portion of the seat are flexed downwardly about a central portion of the seat to form a saddle-like shape.

In another form thereof, the present invention provides a chair, including seat support structure; and a seat supported by the seat support structure, the seat formed of a flexible material having at least one rigid member embedded therein, the seat resiliently movable between an unflexed position and a flexed position in which opposite sides of a front portion of the seat are flexed downwardly about a central portion of the seat to provide a saddle-like shape.

In a further form thereof, the present invention provides a chair, including seat support structure including a rigid support member; and a seat supported by the seat support structure, the seat including a flexible portion disposed centrally within the seat, the flexible portion supported by the rigid support member; a rigid portion disposed along each side portion of the seat opposite the flexible portion, the seat resiliently movable between an unflexed position and a flexed position in which the side portions of the seat flex downwardly about opposite sides of the flexible portion to form a saddle-like shape.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
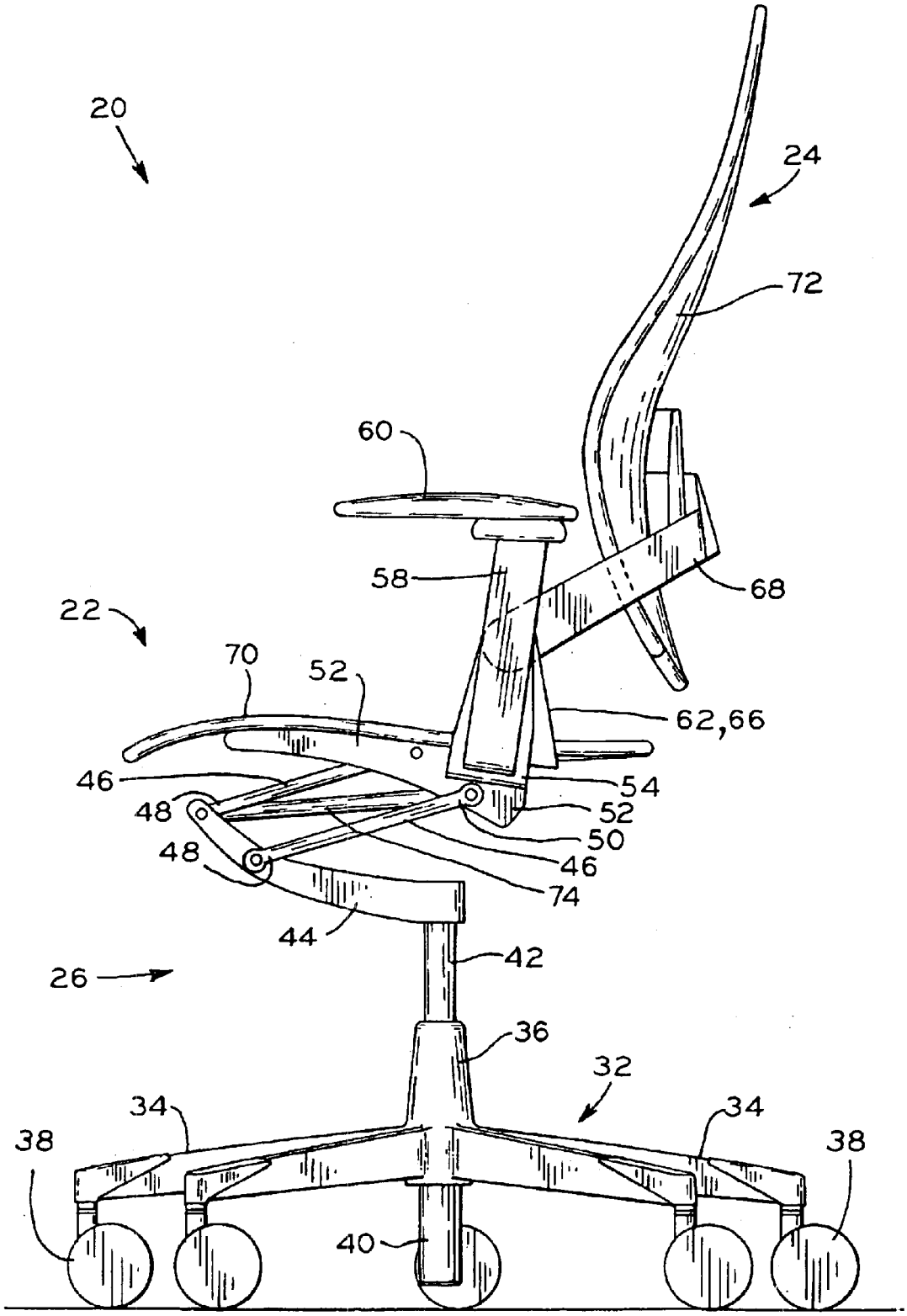
FIG. 1 is a side elevational view of a task chair in accordance with the present invention.
Figure 2:
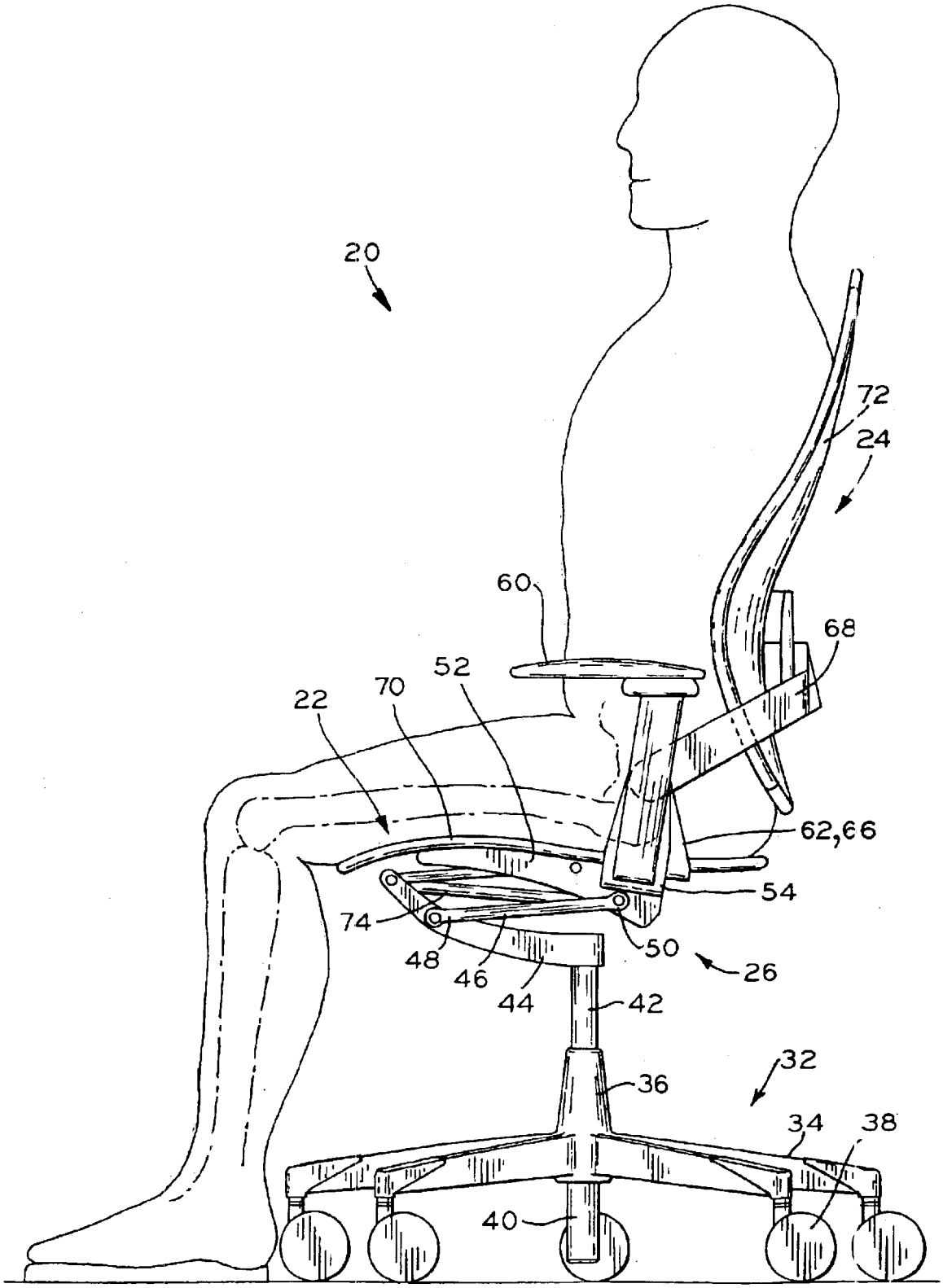
FIG. 2 is an additional side elevational view of the task chair of FIG. 1, schematically showing a user seated therein.
Figure 3:
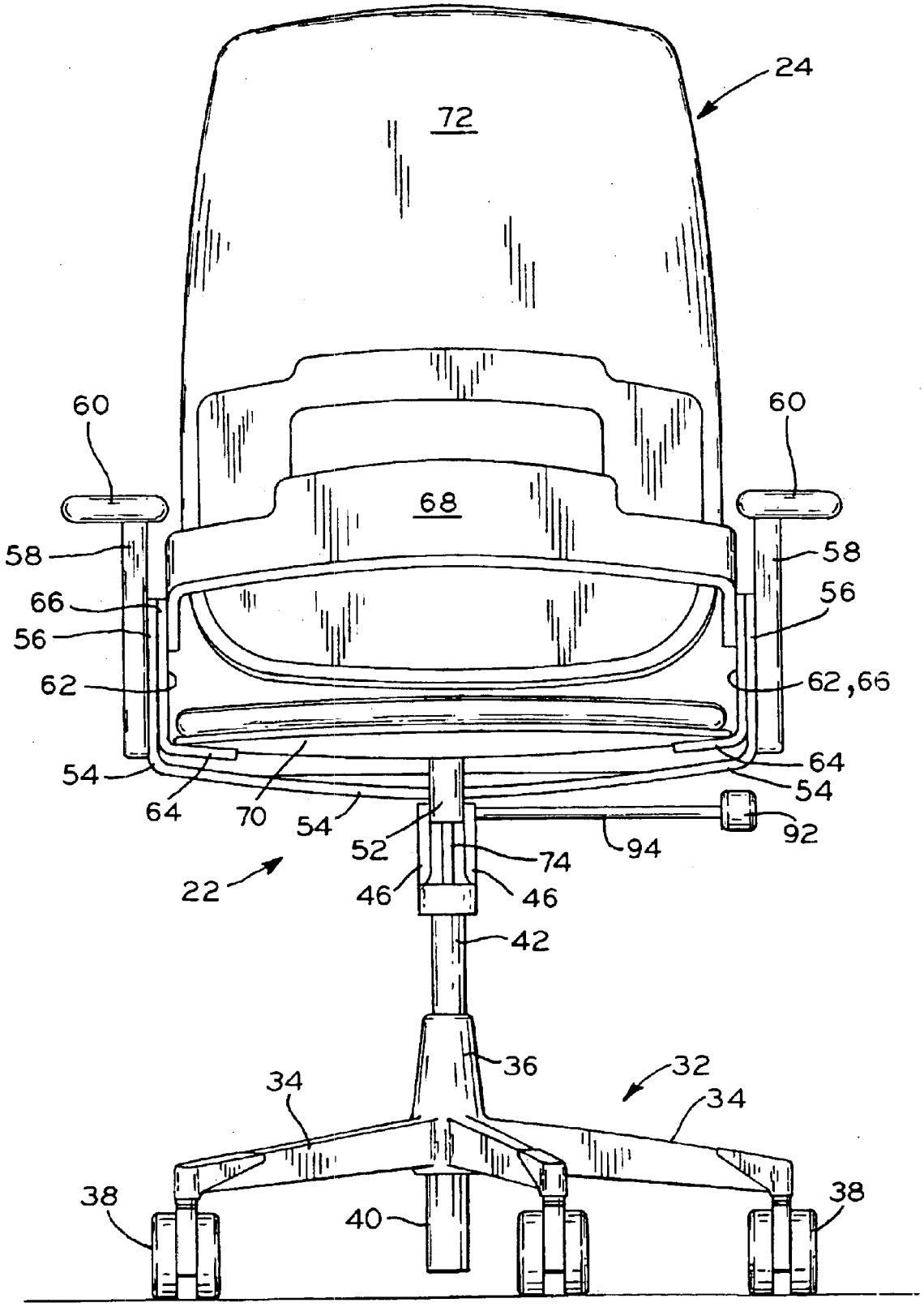
FIG. 3 is a rear elevational view of the task chair of FIG. 1.

Task chair 20 is shown in FIGS. 1–3, and generally includes seat portion 22, backrest portion 24, and seat support structure 26. Seat support structure 26 includes caster wheel assembly 32 having a plurality of arms 34 projecting radially outwardly of central hub 36, the terminal ends of arms 34 having caster wheels 38 pivotally mounted thereon. Supported within central hub 36 of caster wheel assembly 32 is a height-adjustable pneumatic cylinder 40. Cylinder 40 includes piston 42 slidably disposed therein, an upper end of which is attached to chair support beam 44 by a press fit or in another suitable manner.

A plurality of links 46 (only two of which are shown in FIGS. 1 and 2 for clarity) each include first ends 48 pivotally attached to chair support beam 44 and second ends 50 pivotally attached to seat support member 52. Referring to FIG. 3, seat support member 52 is connected to U-shaped arm support 54 having upper ends 56 to which a pair of adjustable or fixed armrests 58 are connected. Armrests 58 may include moveable armrest pads 60, which may be adjusted as desired by a user. Also attached to upper ends 56 of U-shaped arm support 54 are a pair of L-shaped brackets 62 including lower ends 64 supporting chair seat 70, and upper ends 66 pivotally attached to U-shaped arm support 54. Backrest frame 68 extends between and is moveably mounted to upper ends 66 of the two L-shaped brackets 62 and arm support 54. Backrest frame 68 is connected to and supports backrest 72 in a manner such as that described in U.S. Provisional Patent Application Serial No. 60/340,673, entitled CHAIR WITH LUMBAR SUPPORT AND CONFORMING BACK, filed Dec. 14, 2001, assigned to the assignee of the present invention, the disclosure of which is incorporated herein by reference. Backrest 72 may further include one or more features such as those described in the above-incorporated U.S. Provisional Patent Application Serial No. 60/340,673.

Figure 4:
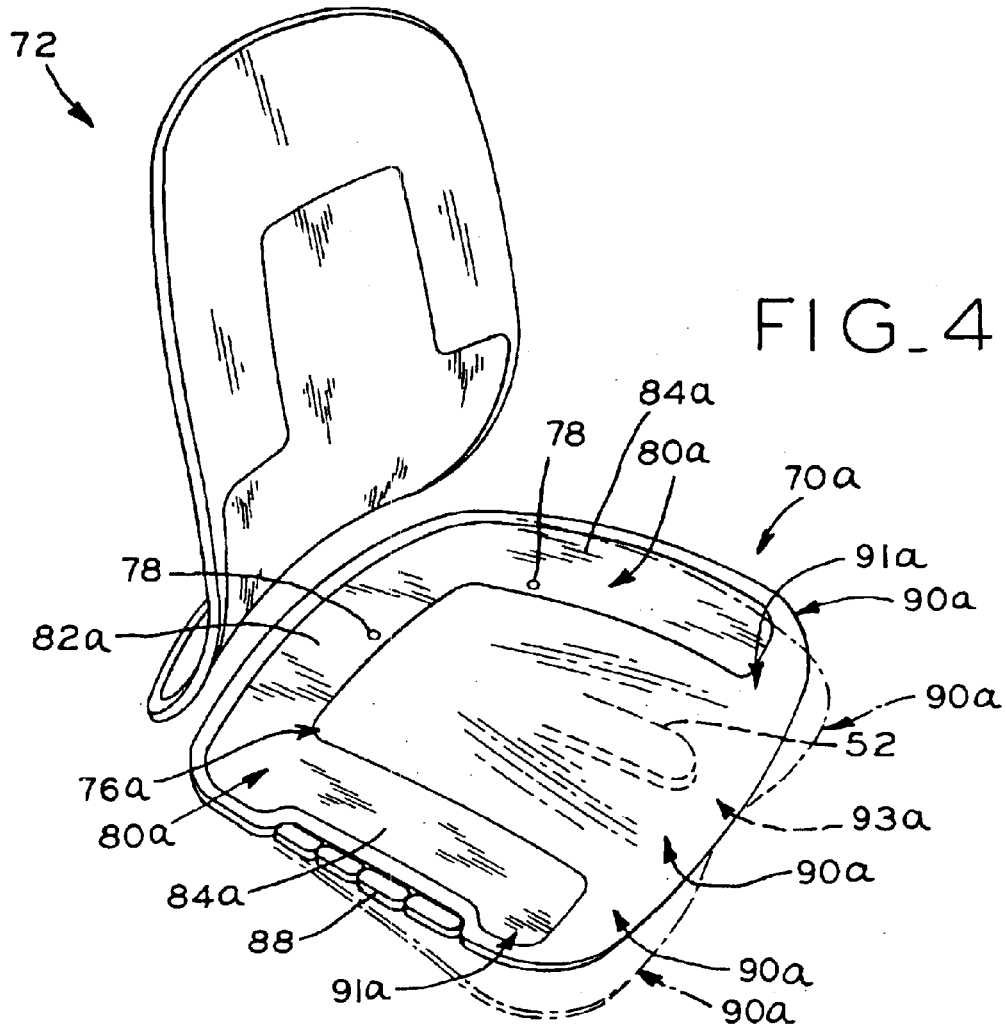
FIG. 4 is a perspective view of one embodiment of a seat for the task chair of FIG. 1, showing the rigid and flexible portions of the seating surface, and further showing the flexing of the seating surface between a first position shown in solid lies and a second position shown in dashed lines.

Referring to FIG. 4, a first embodiment of seat 70 is shown. Seat 70*a* includes seating surface 76*a* defined by a rigid portion and a flexible portion, which are designated as 80*a* and 90*a*, respectively, in the embodiment of FIG. 4. Rigid portion 80*a* is generally U-shaped, with base section 82*a* and a pair of arm sections 84*a* extending therefrom toward the front of seat 70*a*. Flexible portion 90*a* is disposed around the periphery of rigid portion 80*a* and between arm sections 84*a* thereof. Control knobs 88 may be integrated into the profile of seat 70*a* for adjusting various adjustment features of chair 20.

The rigid portion of seat 70 may be made from any suitable substantially rigid material, such as wood, metal, or a stiff plastic material, for example. Suitable wood materials for the rigid portion include, for example, a 9-ply, gumwood, upholstery grade plywood or a rotary cut maple veneer shell.

The flexible portion of seat 70 may be made from an elastomeric material, such as a urethane or a silicone material, for example. Such material may have one or more of a shore hardness ranging from 37±7A to 82±7A, a tensile strength ranging from 505 PSI to 2200 PSI as determined by ASTM D-412, and an elongation of 320% to 340% as determined by ASTM D-368. Suitable urethane materials for the flexible portion include Vantico brand polyurethanes, available from Ciba Specialty Chemicals, such as RP6400-1, RP6401-1, RP 6402-1, and RP 6410-1 polyurethanes. The thickness of the flexible portion may be uniform throughout the seat, or alternatively, the thickness of the flexible portion may be varied as desired. The flexibility of the flexible portion generally decreases with increasing material thickness. Conversely, the flexibility of the flexible portion generally increases with decreasing material thickness.

In each of the embodiments of the seats disclosed herein, the flexible portion of the seat is resiliently flexible, such that the flexible portion may flex or bend to change shape in response to a force or load exerted thereon, followed by return of the flexible portion to its original shape or position when the force or load is removed. The material of the flexible portion may also exhibit elasticity, wherein the material may stretch as necessary responsive to forces exerted thereon, followed by return to its original shape and position. Further, the flexible portion may optionally include a series of perforations, a series of ridges and valleys, scoring, or other features therein which facilitate flexing movement in designated areas of the flexible portion.

The flexible portion of seat 70 is attached to one or more rigid portions thereof by insert molding, wherein the rigid portion is placed in a mold, and the flexible portion is molded therearound such that, upon curing, the flexible portion surrounds the periphery of the rigid portion and is securely adhered to the rigid portion. For example, if the rigid portion is made of wood or another porous or semi-porous material having roughened surfaces, the flexible portion may penetrate within the interstices of the rigid portion and, upon curing, form a tight bond with same.

Another molding process which may be used to form seat 70 is performed according to a two-step molding procedure, sometimes referred to in the art as a "two-shot" molding process. First, the rigid portions are formed from a first plastic material which is substantially rigid upon curing. The first material is injected into one or more molds which correspond to the shape of the rigid portions of the seat. Then, before the material of the rigid portions is fully cured, the flexible material is injected around the rigid portions into a mold which corresponds to the shape of the seat. The flexible material forms a chemical bond with the partially cured rigid material to provide a very strong connection between the rigid and flexible portions of the seat. After the flexible and rigid materials cure, the mold is removed to provide the seat.

The rigid portion is at least partially embedded within the flexible portion such that the flexible portion surrounds the outer periphery of the rigid portion. The top and bottom surfaces of the rigid portion may be exposed, or alternatively, the rigid portion may be completely embedded or encapsulated within the flexible portion such that the flexible portion encompasses all sides of the rigid portion.

Further, as shown in FIG. 4, the rigid portion 80*a* may include cavities (not shown) which communicate with holes 78 therein into which flexible portion 90*a* fills during molding to further anchor flexible portion 90*a* to rigid portion 80*a*. Alternatively, the flexible portion may be pre-molded, wherein after curing thereof, the flexible portion is mechanically joined to the rigid portion by a suitable adhesive or by suitable fasteners, for example.

Seating surface 76*a* is shown in FIG. 4 in a first position in solid lines. In this first position, seating surface 76*a* is generally flattened or planar in overall shape, but may have some inherent contour therein based upon the shapes of rigid portion 80*a* and/or flexible portion 90*a*. For example, seating surface 76*a* may be slightly curved upwardly at the opposite side edges thereof, the front edge of seating surface 76*a* may be slightly curved downwardly, or the rear edge of seating surface 76*a* may be slightly curved upwardly.

Seating surface 76*a* is shown in FIG. 4 in a second position in solid lines, in which seating surface 76*a* is flexed or elastically moved into a saddle or saddle-like shape. In this position, the central area of seating surface 76*a*, toward the front of seat 70, is supported by seat support member 52. Additionally, the rear side portions of seating surface 76*a* are supported in a suitable manner, such as by L-shaped seat support brackets 62 (FIG. 3). Therefore, seating surface 76*a* is more firmly supported in the forward central portion of the seat and on the sides in the rear of the seat to provide a relatively firm support for the buttocks of a seated user. However, the front side portions 91*a* of seating surface 76*a*, when same are not supported by seat support structure 26, may flex downwardly about each side of seat support member 52 under the weight of the thighs of a seated user, such that the central front portion of seating surface 76*a*, which is supported by seat support member 52, forms a protuberance 93*a* which is disposed between front side portions 91*a* of seating surface 76*a*. Flexible portion 90*a* may stretch as necessary in the area of seat support member 52 to accommodate downward movement of front side portions 91*a*.

When a seated user leans rearwardly in the chair, the weight of the user is distributed to a greater extent through the user's buttocks to the rear portion of seating surface 76*a* than through the user's thighs to the front portion of seating surface 76*a*, and therefore, front side portions 91*a* flex downwardly about seat support member 52 to a limited extent, or not at all. However, when the user leans forwardly in the chair, the weight of the user is distributed to a greater extent through the user's thighs to the front portion of seating surface 76*a* than through the user's buttocks to the rear portion of seating surface 76*a*, and therefore, front side portions 91*a* may flex further downwardly about seat support member 52.

The saddle-like shape of seating surface 76*a* provides a flexible, conforming, ergonomic support for the seated user. The protuberance 93*a* formed in the front, central portion of seating surface 76*a* by the flexing of front side portions 91*a* downwardly about seat support member 52 is disposed between the thighs of the seated user, and prevents the seated user from experiencing the sensation of failing or sliding forwardly out of the chair. In addition, seating surface 76*a* supports the seated user when the chair is disposed in either an upright or reclined position, as described further below. Notably, seating surfaces 76*b* (FIG. 14), 76*c* (FIG. 15), 76*d* (FIG. 16), and 76*e* (FIGS. 17A and 17B) are also resiliently moveable into a saddle-like shape to support a seated user as described above with respect to seating surface 76*a*.

Figure 5:
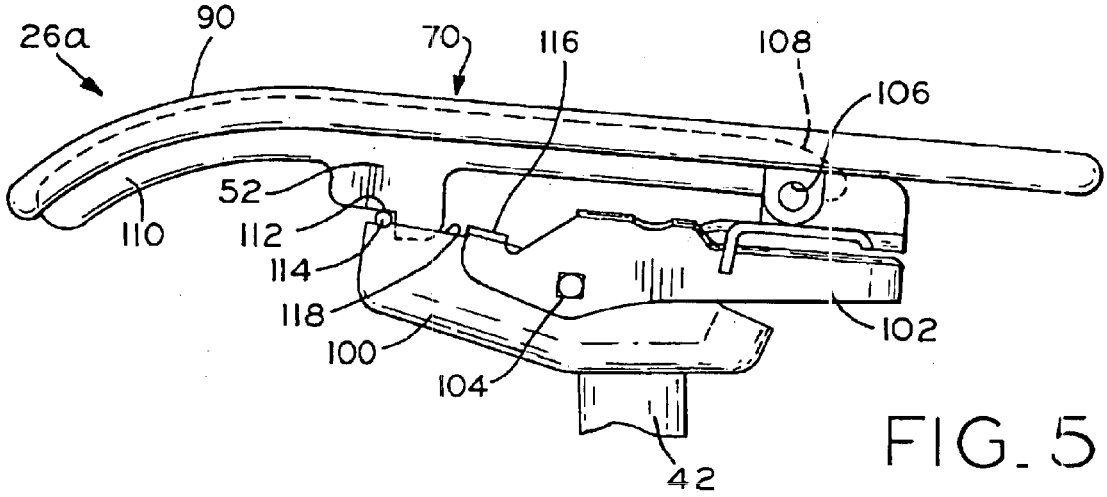
FIG. 5 is a side perspective view of a first embodiment of a seat support structure, showing the seat support structure in a high or upright position with the seat in a non-flexed shape.
Figure 6:
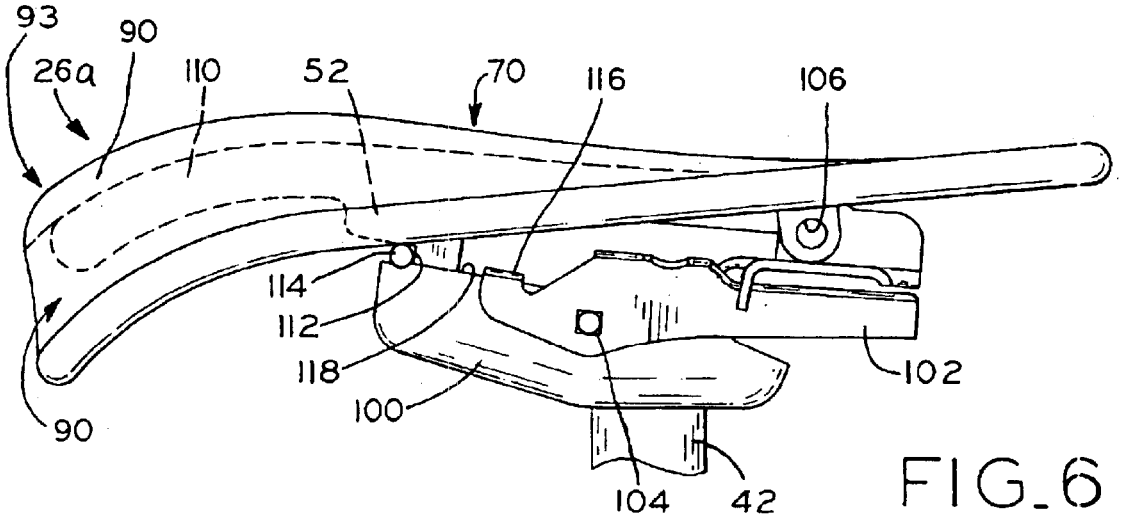
FIG. 6 is side perspective view of the seat support structure of FIG. 5, showing the seat support structure in a high or upright position with the seat flexed in a saddle-like shape.
Figure 7:
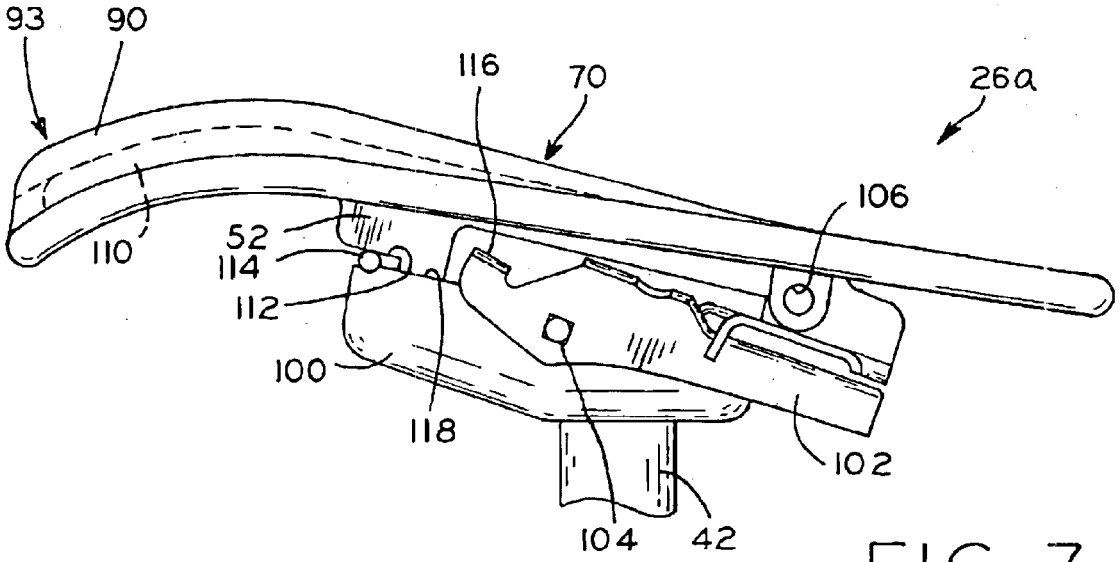
FIG. 7 is side perspective view of the seat support structure of FIGS. 5 and 6, showing the seat support structure in a low or reclined position, with the seat flexed in a saddle-like shape.

A first embodiment of seat support structure 26 is shown in FIGS. 5–7. Seat support structure 26*a* includes lower housing 100, which is mounted to the upper end of piston 42 of pneumatic cylinder 40 (FIGS. 1–3). Upper housing 102 is pivotally attached to lower housing 100 at central pivot 104. Rear end 108 of seat support member 52 and the rigid portion of seat 70 are each pivotally attached to upper housing 102 at rear pivot 106. Forward end 110 of seat support member 52 supports the flexible portion 90 of seat 70 thereon. Seat support member 52 further includes recess 112 in abutment with stop pin 114 secured to lower housing 100.

In FIG. 5, seat 70 is shown in a position in which seat 70 is either unoccupied by a user, or in which seat 70 is occupied by a user with the flexing of seat 70 prevented or "locked out" by a flex lockout mechanism, which is described below. In the position shown in FIG. 5, seat 70 is disposed in a relatively planar orientation in which seat 70 is not ergonomically flexed into a saddle-like shape.

Seat 70 is shown in a saddle-like shape in FIG. 6. In this position, the flex lockout mechanism is disengaged such that flexing of seat 70 from the substantially planar position shown in FIG. 5 to the saddle-shaped position is permitted. Specifically, when a user sits in seat 70, the user's thighs shift downwardly, causing the rigid portion of seat 70 to pivot about rear pivot 106 and the flexible portion 90 of seat 70 to flex downwardly about seat support member 52. The saddle-like shape of seat 70 supports the user in a conforming, ergonomic manner, preventing the user from experiencing the sensation of falling forwardly or sliding out of the chair, as described above.

In each of the positions shown in FIGS. 5 and 6, a spring (not shown) operably connected between lower housing 100 and upper housing 102 biases the rear portion of upper housing 102 upwardly from lower housing 100 about central pivot 104 such that stop catch 116 of upper housing 102 abuts upper edge 118 of lower housing 100. The respective abutments between stop catch 116 of upper housing 102 and upper edge 116 of lower housing 100, and between recess 112 of seat support member 52 and stop pin 114 of lower housing 100, prevent upper housing 102 and seat support member 52 from tilting forwardly from the position shown in FIGS. 5 and 6.

Seat support structure 26*a* is shown in a reclined or low position in FIG. 7, in which the weight of a user leaning backwardly in seat 70 overcomes the bias force of the spring between lower housing 100 and upper housing 102, and upper housing 102 pivots rearwardly and downwardly about central pivot 104 with respect to lower housing 100. As seat 70 is so reclined, stop catch 116 of upper housing 102 moves out of engagement with upper edge 118 of lower housing 100, and seat support member 52 slides with respect to lower housing 102 such that recess 112 of seat support member 52 moves out of abutment with stop pin 114 of lower housing 100.

Further, in the position shown in FIG. 7, the flex lockout mechanism is disengaged, such that flexing of seat 70 is allowed, helping to prevent slide-out of the seated user, as described above.

Also, support structure 26*a* may be reclined by the user from the position shown in FIG. 5 even when the flexing of seat 70 is prevented by engagement of the flex lockout mechanism. Specifically, during the operation of seat support structure 26*a* as shown in FIGS. 5–7, the flexing of seat 70 is either prevented or allowed by the flex lockout mechanism regardless of whether seat support structure 26*a* is in an upright or in a reclined position. Conversely, the reclining of seat support structure 26*a* is determined by the positioning of the weight of the user, and is not dependent upon whether seat 70 is in a substantially planar or in a flexed position. Thus, the flexing of seat 70 and the upright/reclined positioning of seat support structure 26*a* operate independently of one another.

Figure 8:
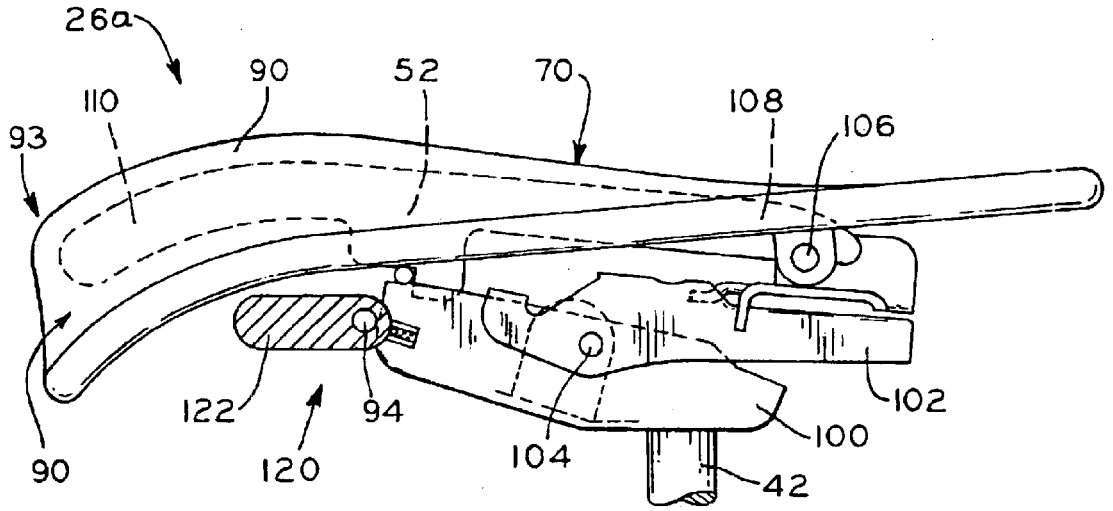
FIG. 8 is side perspective view of the seat support structure of FIG. 5, further showing a flex lockout mechanism disposed in a disengaged position, such that flexing of the seat allowed.
Figure 9:
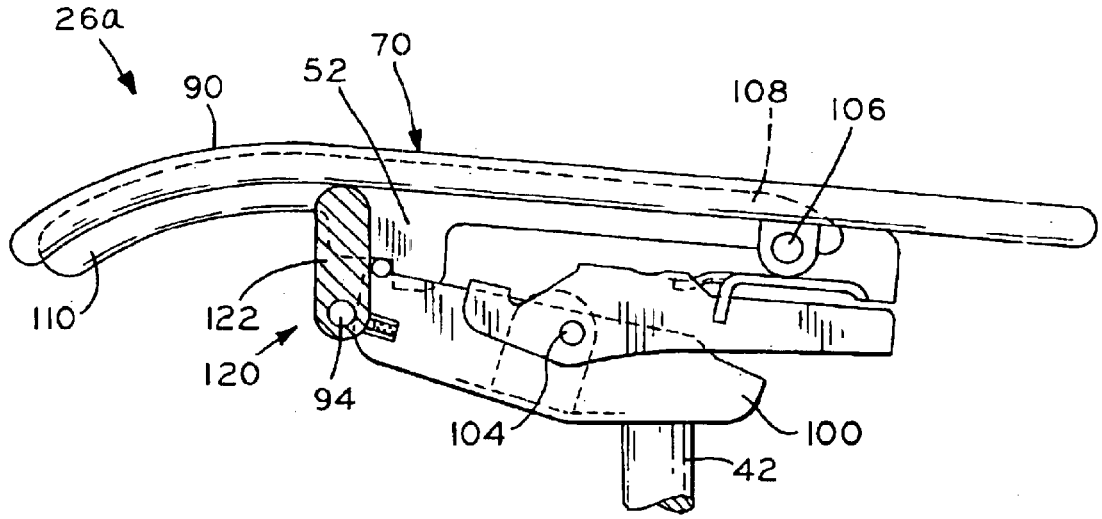
FIG. 9 is side perspective view of the seat support structure of FIG. 8, showing the flex lockout mechanism disposed in an engaged position, such that flexing of the seat is prevented.

One suitable flex lockout mechanism 120 for seat support structure 26*a* is shown in FIGS. 8 and 9, and may include an actuation member such as adjustment knob 92 (FIG. 3), for example, attached to rod 94 for moving flex lockout mechanism 120 between the disengaged position shown in FIG. 8 and the engaged position shown in FIG. 9. Seat support cams 122 are attached to rod 94, and contact the undersides of a suitable portion of seat 70, such as arm sections 84*a* of the rigid portion 80*a* of seat 70*a*, for example. In the disengaged position shown in FIG. 8, seat support cams 122 are shifted away from the underside of seat 70, thereby permitting the flexible portion of seat 70 to flex about seat support member 52. The actuation member, such as adjustment knob 92, may be turned to rotate rod 94 and seat support cams 122 to the engaged position shown in FIG. 9, in which seat support cams 122 are disposed beneath and contact the underside of seat 70, preventing the flexible portion 90 of seat 70 from flexing about seat support member 52.

A second embodiment of seat support structure 26 is shown in FIGS. 10–13. Seat support structure 26*b* includes chair support beam 44 mounted to the upper end of piston 42 (FIGS. 1–3) of pneumatic cylinder 40. A plurality of links 46*a*, 46*b* (only two of which are visible in FIGS. 10–13) each include first ends 48 pivotally attached to chair support beam 44 and second ends 50 pivotally attached to seat support member 52. Second end 50 of link 46*a* is attached to axle 123, which is slidably received within slot 124 of seat support member 52. Seat support member 52, links 46*a*, 46*b*, and chair support beam 44 together may form a four bar pivot structure, as described in further detail below.

Upper ends 56 of U-shaped arm support 54 and upper ends 66 of L-shaped brackets 62 (FIG. 3) are pivotally attached to one another at main pivot 128. Specifically, upper ends 66 of L-shaped brackets 62 are pivotally mounted to upper ends 56 of arm support 54 at main pivot 128, and arm support 54 extends transversely under seat 70, as shown in FIG. 3, and is rigidly connected to seat support member 52. Upper ends 66 of L-shaped brackets 62 are pivotally mounted at main pivot 128, and lower ends 64 of L-shaped brackets 62 support seat 70. Tension element 74, shown as a tension spring, for example, is attached between chair support beam 44 and chair support member 52. Alternatively, tension element 74 may be a tension band, as shown in FIGS. 1 and 2, which is made from a heavy, yet stretchable, rubber material.

Figure 10:
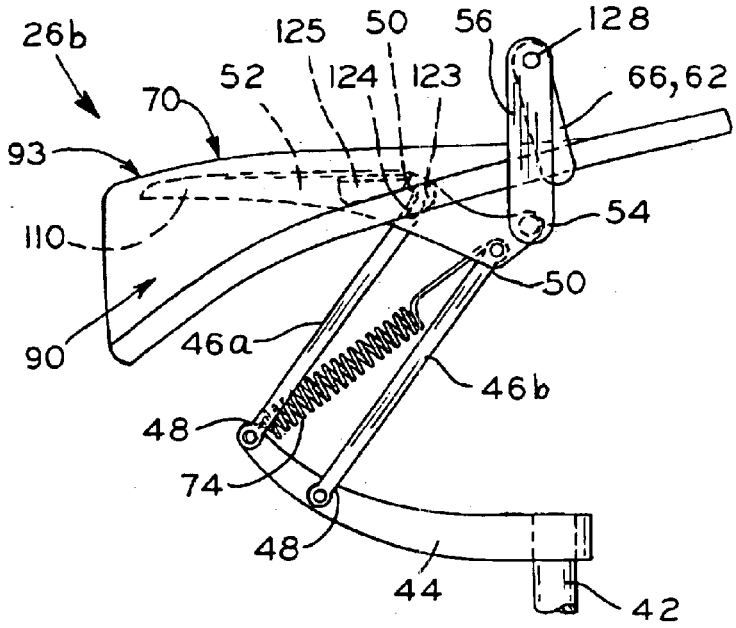
FIG. 10 is a side perspective view of a second embodiment of a seat support structure, showing the seat support structure in a high or raised position with the seat flexed into a saddle-like shape.

Tension element 74 biases seat support structure 26*b* upwardly to the high position shown in FIG. 10 when a user is not seated within chair 20. When a user is seated in chair 20, tension element 74 begins to stretch, lowering seat support structure 26*b* to the middle position shown in FIG. 11, or to any intermediate position between the positions shown in FIGS. 10 and 12, depending upon the such factors as the weight of the user, the position of the user's center of gravity, the angle of the backrest, and the resistance to stretching of tension element 74.

FIG. 10 shows seat 70 in a saddle-like shape which is attained when the user releases the flex lockout mechanism of seat 70, such as that shown in FIGS. 8 and 9. Specifically, the weight of the user's legs shifts the user's thighs downwardly and causes seat 70 and upper ends 66 of L-shaped brackets 62 to pivot about main pivot 128 to a forward tilt position, and flexible portion of seat 70 to flex downwardly about seat support member 52.

Figure 11:
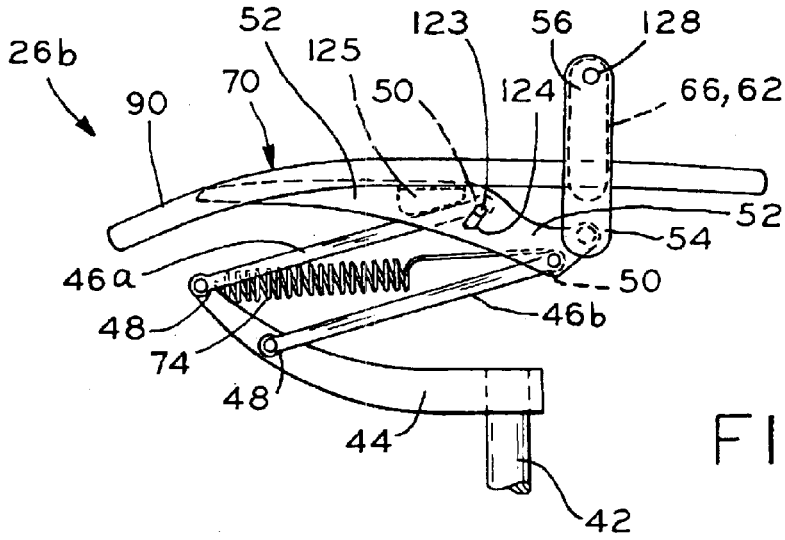
FIG. 11 is a side perspective view of the seat support structure of FIG. 10, showing the seat support structure in a middle position with the seat in a non-flexed shape.

When a position lock (not shown) is released, links 46*a*, 46*b* and upper ends 66 of L-shaped brackets 62 pivot such that seat support member 52 is raised from the middle position shown in FIG. 11 to the position shown in FIG. 10. In FIG. 10, the flex lockout mechanism is disengaged, such that flexing of seat 70 from the substantially planar position shown in FIG. 11 to the saddle-shaped position is permitted. As described above, the saddle-like shape of seat 70 supports the user in a conforming, ergonomic manner, preventing the user from experiencing the sensation of falling forwardly or sliding out of the chair 20.

In FIG. 11, seat support structure 26*b* is shown in a middle position, in which seat 70 is occupied by a user with the flexing of seat 70 prevented or "locked out" by the flex lockout mechanism. Thus, in the position shown in FIG. 11, seat 70 is disposed in a relatively planar orientation in which seat 70 is not ergonomically flexed into a saddle-like shape.

Figure 12:
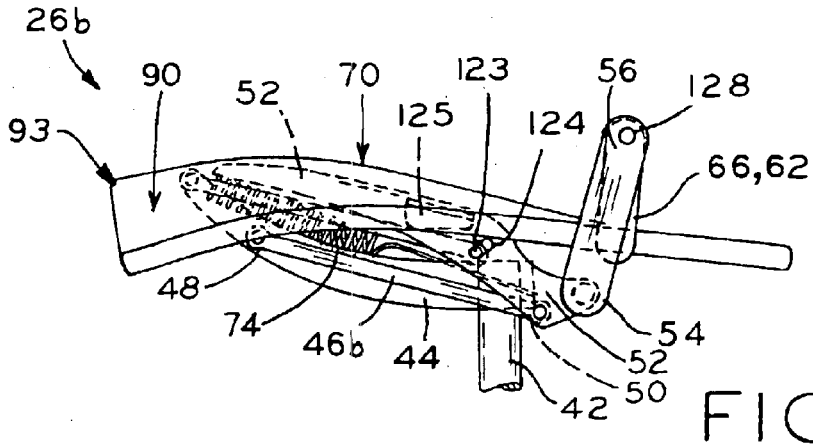
FIG. 12 is a side perspective view of the seat support structure of FIGS. 10 and 11, showing the seat support structure in a low or reclined position with the seat flexed into a saddle-like shape.

Seat support structure 26*b* is shown in a low or reclined position in FIG. 12, in which the weight of a user leaning backwardly in seat 70 shifts the user's torso weight still further rearward to further overcome the bias force of tension element 74. U-shaped arm support 54 and seat support member 52 shift downwardly, and upper ends 66 of L-shaped brackets 62 pivot about main pivot 128. Additionally, as may be seen most clearly in FIG. 13, block 125 on the underside of seat support member 52 contacts link 46*a* when seat support structure 26*b* is in a middle position. When seat support structure 26*b* is moved from the middle position to the low/reclined position, block 125 pushes against link 46*a*, causing slot 124 of seat support member 52 to slide relative to (or around) axle 123, permitting seat support member 52 to recline.

Further, in the low position shown in FIG. 12, the flex lockout mechanism is disengaged, such that flexing of seat 70 is allowed even when seat support structure 26*b* is in a low/reclined position, preventing the user from sliding forward in seat 70 and from disengaging his/her lumbar region from the backrest of chair 20.

Figure 13:
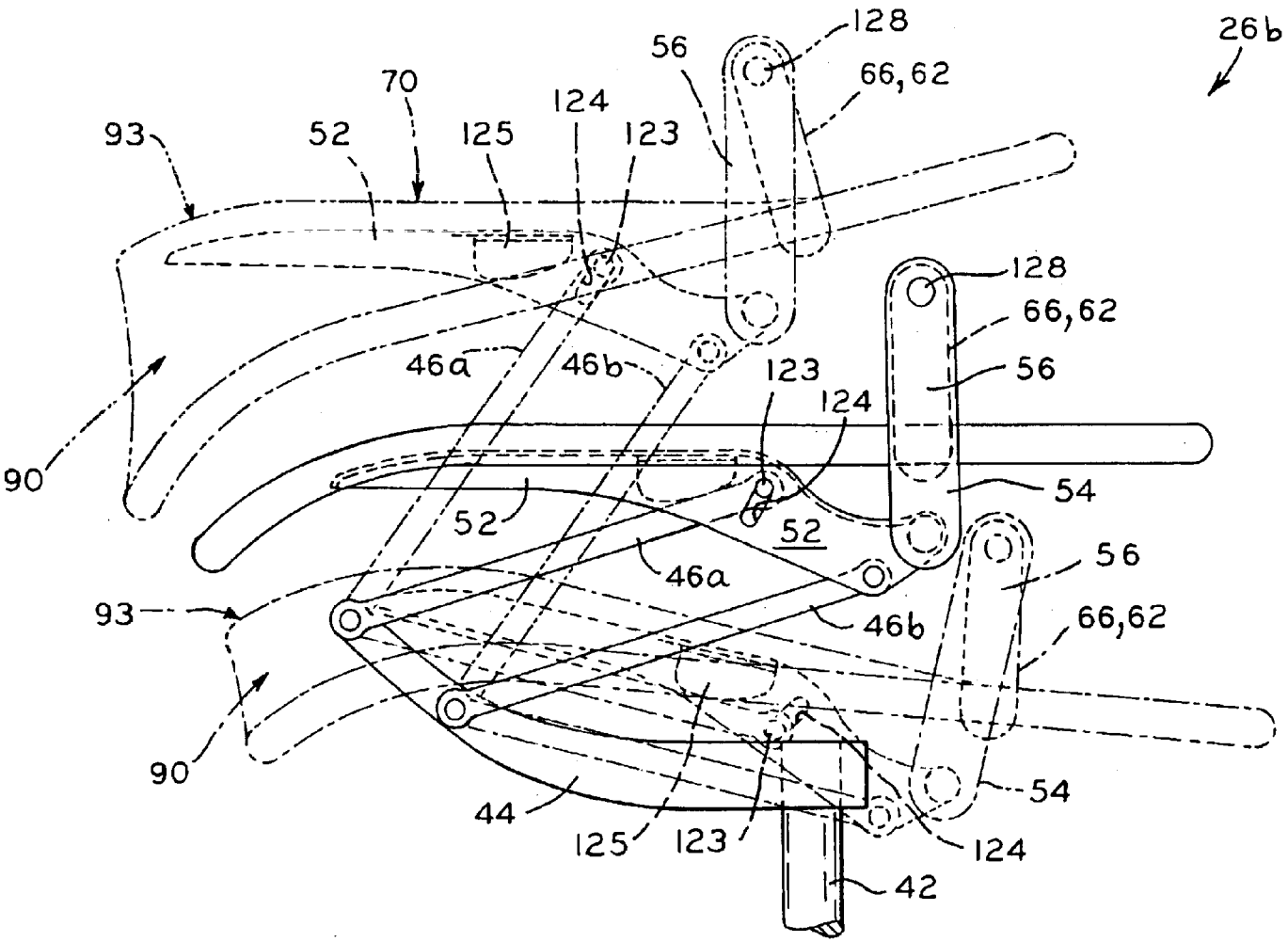
FIG. 13 is a side perspective view of the seat support structure of FIGS. 10–12, showing each of the individual positions of FIGS. 10–12 with respect to one another.

The above-described high, middle, and low positions of seat support structure 26*b* are each shown in FIG. 13 in relation to one another, wherein tension element 74 has been omitted for clarity.

Also, seat support structure 26*b* may be raised or lowered by the user from the position shown in FIG. 11 even when the flexing of seat 70 is prevented by engagement of the flex lockout mechanism. In this connection, during the operation of seat support structure 26*b* as shown in FIGS. 10–13, the flexing of seat 70 is either prevented or allowed by the flex lockout mechanism regardless of whether seat 70 is in a high (FIG. 10), middle (FIG. 11) or low (FIG. 12) position. Conversely, the high position and low position of seat support structure 26*b* is determined by the positioning of the weight of the user, and is not dependent upon whether seat 70 is in a substantially planar or in a flexed position. Thus, the flexing of seat 70 and the raising or lowering of seat support structure 26*b* operate independently of one another.

In each of the embodiments disclosed herein, at least a portion of the seat support member 52 of seat support structure 26 supports the front central region of seat 70. Seat support member 52, or a portion thereof, may be pivotally attached to the remainder of seat support structure 26 to enable seat support member 52 to remain in supporting contact with the underside of seat 70 throughout movement of seat support structure 26 between high and low positions.

As discussed below, and regardless of the type of seat support structure 26 which is employed in chair 20, the shapes and relative configurations of the rigid portions and the flexible portions of seat 70 may be varied substantially in order to selectively modify the nature of the support provided by the rigid portions and the flexible portions, as well as the dynamics of the flexing of the seating surface of seat 70. The embodiments of FIGS. 14–17B illustrate some possible shapes and relative configurations of the rigid portions and the flexible portions, although one of ordinary skill in the art may develop others based upon the teachings herein.

Figure 14:
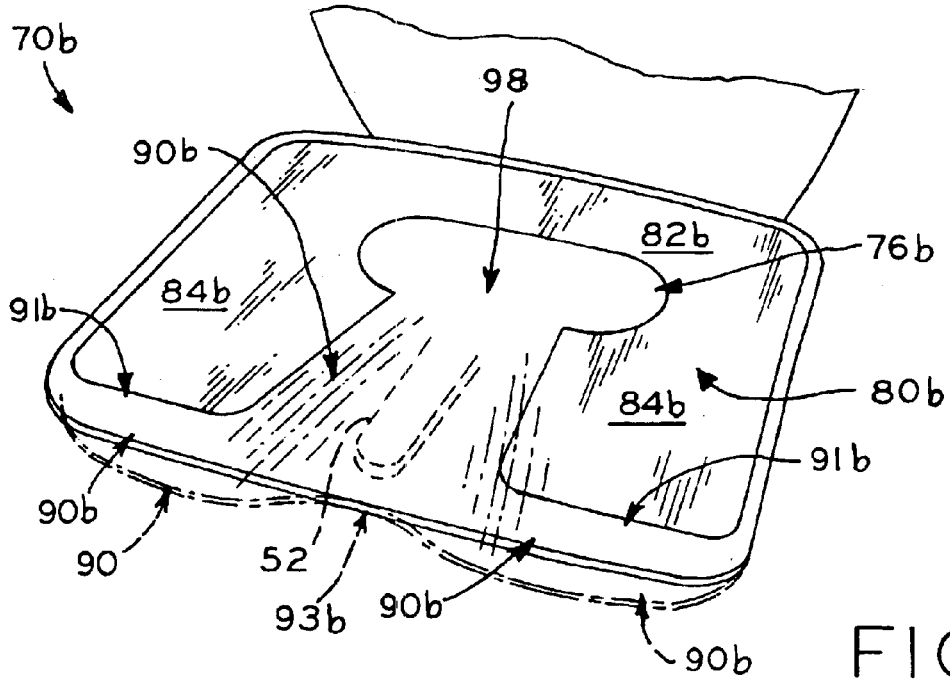
FIG. 14 is a partial perspective view of a second embodiment of a seat, showing the rigid and flexible portions of the seating surface, and further showing the flexing of the seating surface between a first position shown in solid lies and a second position shown in dashed lines.

A first additional embodiment of seat 70 is shown in FIG. 14. Seat 70*b* includes seating surface 76*b* formed by rigid portion 80*b* and flexible portion 90*b*. Rigid portion 80*b* is generally U-shaped, and includes base section 82*b* and arm sections 84*b* extending therefrom. Rigid portion 80*b* also includes a substantially oval-shaped cutout portion 96. Flexible portion 90*b* is disposed around the outer periphery of rigid portion 80*b*, between arm sections 84*b*, and within cutout portion 96. The area of flexible portion 90*b* within cutout portion 96 provides a relief area 98 which is disposed beneath the ischium of a seated user to provide flexible, cushioning support thereto. Seating surface 76*b* of 70*b* may flex about seat support member 52 in a manner similar to that of seat 70*a* between a generally planar shape (shown in solid lines) and a saddle-like shape (shown in dashed lines) in which front side portions 91*b* flex downwardly about seat support member 52 to form protuberance 93*b*. Flexible portion 90*b* may stretch as necessary in the area of seat support member 52 to accommodate downward movement of front side portions 91*b*. When seating surface 76*b* is flexed to the saddle-like shape, arm sections 84*b* of rigid portion 80*b* and flexible portion 90*b* provide a flexible support for a seated user's thighs, while base section 82*b* of rigid portion 80*b* provides a more rigid support.

Figure 15:
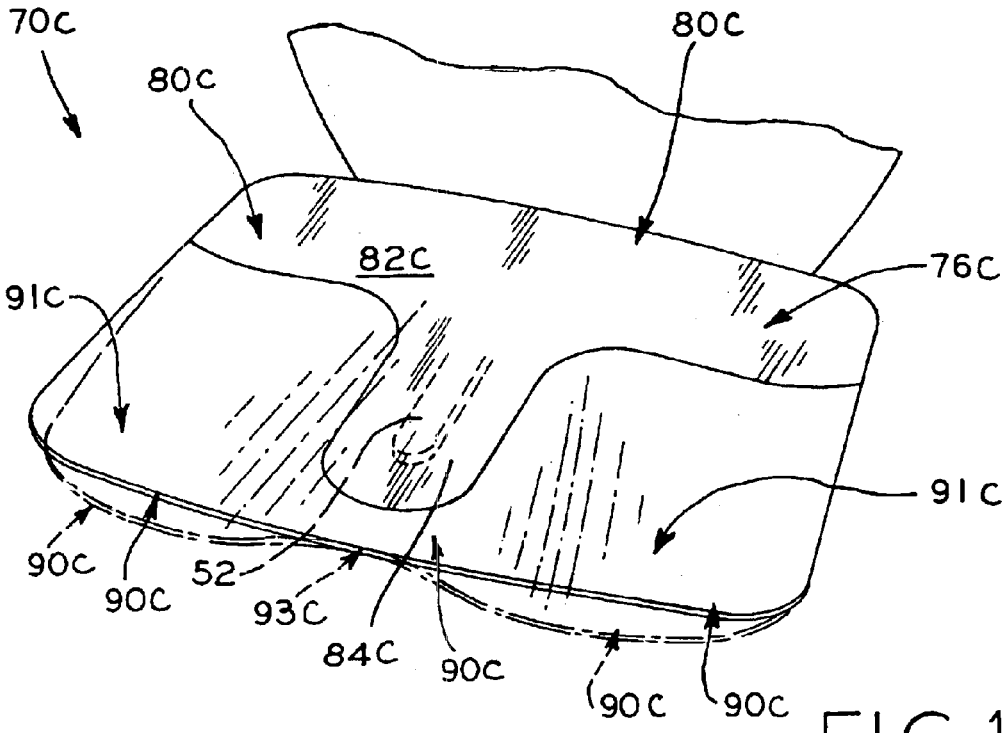
FIG. 15 is a is a partial perspective view of a third embodiment of a seat, showing the rigid and flexible portions of the seating surface, and further showing the flexing of the seating surface between a first position shown in solid lies and a second position shown in dashed lines.

In FIG. 15, another embodiment of seat 70 is shown. Chair seat 70*c* includes seating surface 76*c* formed by rigid portion 80*c* and flexible portion 90*c*. Rigid portion 80*c* includes base section 82*c* and a central, single forwardly projecting arm 84*c* about which flexible portion 90*c* may flex between a generally planar position (shown in solid lines) and a saddle-like-shaped position (shown in dashed lines) in which front side portions 91*c* flex downwardly about seat support member 52 to form protuberance 93*c*. Flexible portion 90*c* may stretch as necessary in the area of seat support member 52 to accommodate downward movement of front side portions 91*c*. Thus, in the embodiment shown in FIG. 15, a flexible support is provided for the thighs of a seated user by flexible portion 90*c*, and a more rigid support is provided by rigid portion 80*c*.

Figure 16:
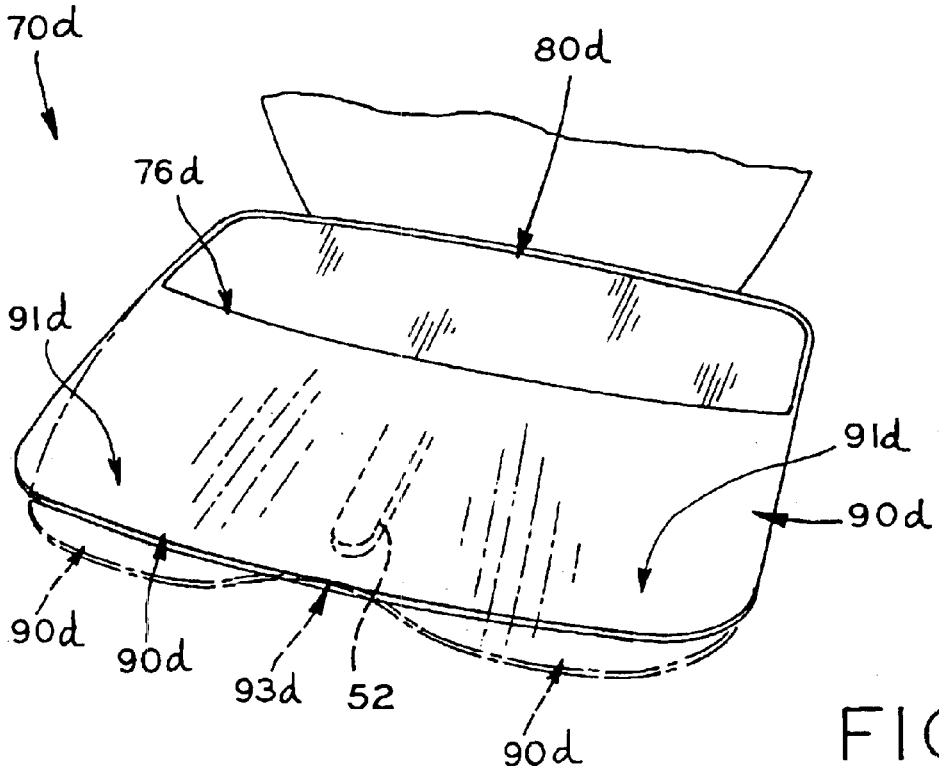
FIG. 16 is a is a partial perspective view of a fourth embodiment of a seat, showing the rigid and flexible portions of the seating surface, and further showing the flexing of the seating surface between a first position shown in solid lies and a second position shown in dashed lines.

A further embodiment of seat 70 shown in FIG. 16. Chair seat 70*d* includes seating surface 76*d* formed by rigid portion 80*d* and flexible portion 90*d*. Rigid portion 80*d* is disposed in the rear portion of seat 70*d*, and flexible portion 90*d* is disposed in the front portion of seat 70*d* and around the periphery of rigid portion 80*d*. Flexible portion 90*d* may flex about seat support member 52 between a generally planar position (shown in solid lines) and a saddle-like-shaped position (shown in dashed lines) in which front side portions 91*d* flex downwardly about seat support member 52 to form protuberance 93*d*. Flexible portion 90*d* may stretch as necessary in the area of seat support member 52 to accommodate downward movement of front side portions 91*d*. Thus, in the embodiment shown in FIG. 16, a flexible support is provided for the thighs of a seated user by flexible portion 90*d*, and a more rigid support is provided by rigid portion 80*d*.

Figure 17A:
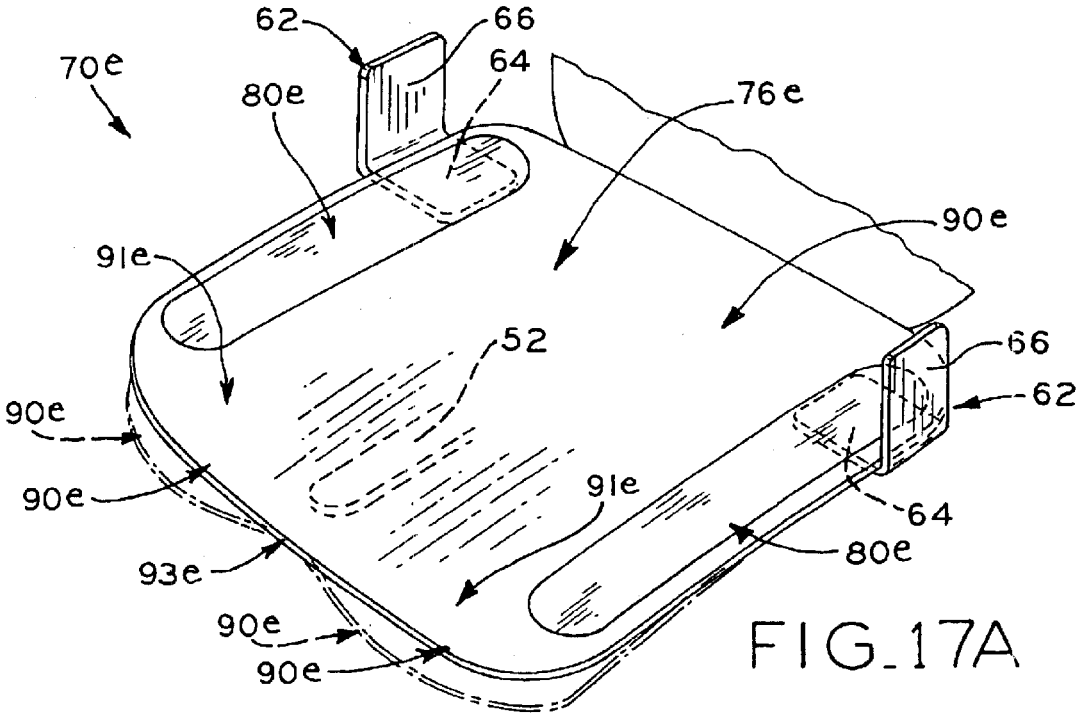
FIG. 17A is a is a partial perspective view of a fifth embodiment of a seat, showing the rigid and flexible portions of the seating surface, and further showing the flexing of the seating surface between a first position shown in solid lies and a second position shown in dashed lines.
Figure 17B:
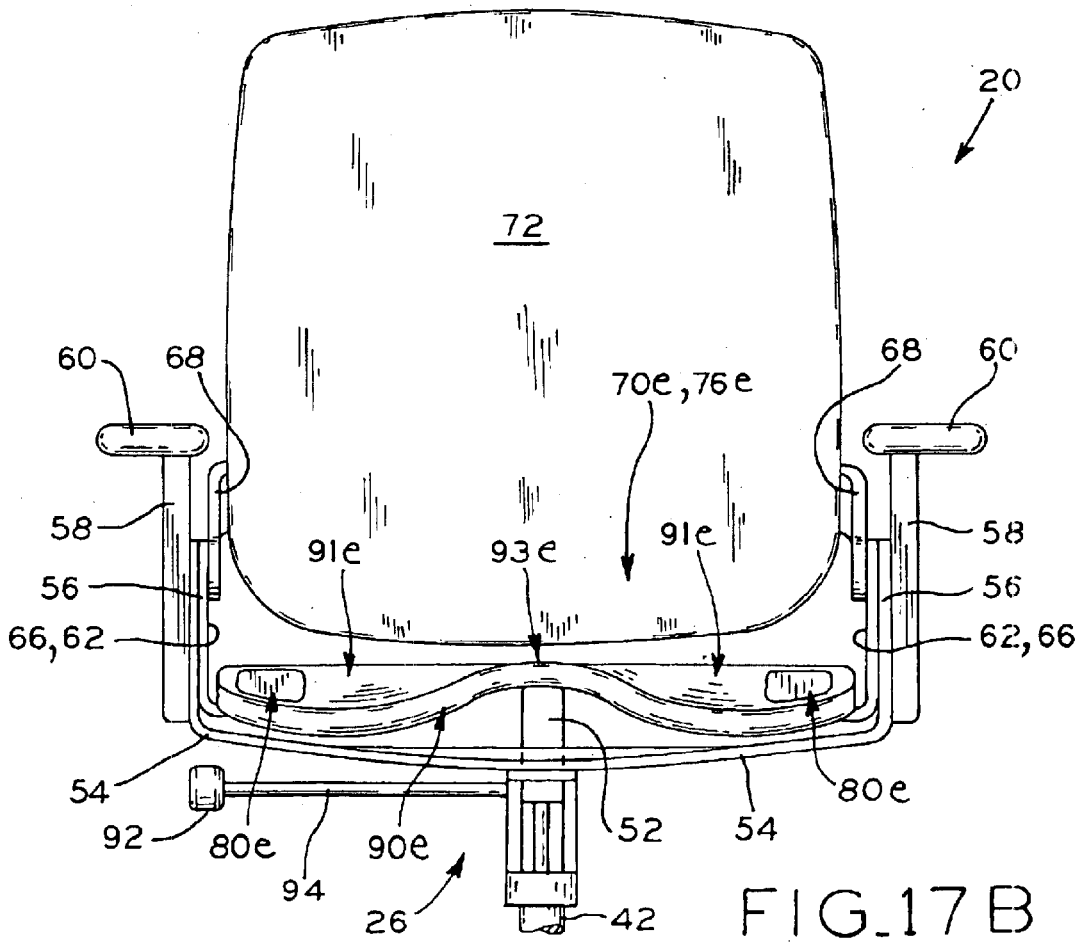
FIG. 17B is a front elevational view of the seat of FIG. 17A, showing the seating surface in a saddle-like shape.

A further embodiment of seat 70 shown in FIGS. 17A and 17B. Chair seat 70*e* includes seating surface 76*e* formed by rigid portions 80*e* and flexible portion 90*e*. Rigid portions 80*e* are disposed along the sides of seat 70*d*, and flexible portion 90*e* is disposed between rigid portions 80*e* and around the outer peripheries of rigid portions 80*e*. In a first position, shown in solid lines in FIG. 17A, seating surface 76*e* has a generally flattened or planar overall shape, but may include some inherent contour therein, such as downward curvature at the front edge of seating surface 76*e*, for example.

Seating surface 76*e* is elastically movable to a second, saddle-shaped form, which is shown in dashed lines in FIG.

17A and is further shown in FIG. 17B. In this position, flexible portion 90*e* flexes about seat support member 52, with front side portions 91*e* of seating surface flexing downwardly under the weight of the thighs of a seated user. Flexible portion 90*e* may stretch as necessary in the area of seat support member 52 to accommodate downward movement of front side portions 91*e*. Front side portions 91*e* will generally flex downwardly about seat support member 52 to a lesser extent (or not at all), when the seated user leans backwardly against backrest 72 and shifts more weight to the user's buttocks, which weight is transferred to the chair through the rear portion of seating surface 76*e* which is supported by L-shaped seat support brackets (FIG. 17B). Conversely, front side portions 91*e* of seat support surface 76*e* will generally flex downwardly about seat support member 52 to a greater extent when the seated user leans forwardly away from backrest 72 and shifts more weight to the front portion of seating surface 76*e*, which weight is transferred to the chair through the user's thighs. In this position, the front portion of seat support member 52 supports flexible portion 90*e* of seating surface 76*e* between front side portions 91*e*, and forms a protuberance 93*e* (FIG. 17B) between front side portions 91*e* at the front of seat support surface 76*e*. This protuberance 93*e* is disposed between the thighs of a seated user and prevents the user from experiencing the sensation of sliding forwardly out of the chair.

Notably, in the embodiment of FIGS. 17A and 17B, as well as in each of the other embodiments disclosed herein, front side portions 91*a–e* of seat support surfaces 76*a–e* may flex downwardly about seat support member 52 under the weight of a user's thighs either concurrently, or independently of one another. For example, if a user leans forwardly and evenly upon a seat support surface 76*a–e*, transferring the user's weight to the seat support surface 76*a–e* evenly through each of the user's thighs, both of the front side portions 91*a–e* of the seat support surface 76*a–e* will flex downwardly about seat support member 52 to the same extent. However, if a user leans forwardly and to one side upon the seat support surface 76*a–e*, transferring the user's weight to the seat support surface 76*a–e* more through one of the user's thighs than the other, one side portion 91*a–e* will flex downwardly to a greater extent than the other side portion 91*a–e*. In this manner, side portions 91*a–e* of seat support surfaces 76*a–e* may flex downwardly about seat support member 52 together, independently of one another, or to mutually varying extents with respect to one another, depending upon the distribution of the user's weight on the seat support surface 76*a–e*.

Additionally, a further embodiment (not shown) of seat 70 may include a rigid portion shaped similarly to rigid portions 80*a–e* of seats 70*a–e* shown in FIGS. 4 and 14–17B, respectively, for example. The rigid portion is fully encapsulated in a flexible portion which is molded around the rigid portion to provide a desired seat shape, wherein such seat may exhibit flexing and conformance characteristics similar to seats 70*a–e* shown in FIGS. 4 and 14–7B.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chair, comprising:

seat support structure including a support member; and a seat formed of a flexible material, said seat comprising:

a central front portion positioned upon and supported by said support member; and a pair of side portions, each side portion including at least one rigid member connected to said flexible material and supported by said seat support structure, said seat resiliently flexible responsive to the weight of a seated user between a first position in which said seat has a generally flat shape, and a second position in which said side portions are flexed downwardly about said support member beneath said central front portion of said seat to form a saddle shape.

2. The chair of claim 1, wherein said flexible material is an elastomeric material.

3. The chair of claim 2, wherein said elastomeric material is one of a flexible urethane material and a flexible silicone material.

4. The chair of claim 1, wherein said rigid members are embedded within said flexible material, said flexible material at least partially surrounding said rigid members.

5. The chair of claim 1, wherein said rigid members are made from one of a metal, a rigid plastic material, and wood.

6. The chair of claim 1, wherein said flexible material occupies an area of said seat which is normally disposed beneath the ischium of a seated user.

7. The chair of claim 1, wherein said side portions of said seat are independently flexible with respect to one another between said first and second positions responsive to the weight of a seated user.

8. The chair of claim 1, wherein said seat support structure includes a pair of uprights disposed on opposite sides of said seat, and a backrest pivotally connected to said uprights.

9. A chair, comprising:

seat support structure; and a seat supported by said seat support structure, said seat having a central front portion disposed between a pair of opposite side portions, said seat formed of an elastically flexible material having at least one rigid member embedded within said flexible material, said seat resiliently movable responsive to the weight of a seated user between a first, unflexed position and a second, flexed position in which said opposite side portions of said seat are flexed downwardly about said central front portion of said seat to provide a saddle shape.

10. The chair of claim 9, wherein said seat support structure comprises a rigid support member disposed centrally beneath said seat, said rigid support member engaging said central front portion of said seat, wherein said opposite side portions of said seat may flex about said rigid support member between said first and second positions.

11. The chair of claim 9, wherein said flexible material is an elastomeric material, said material molded around each of said rigid members.

12. The chair of claim 11, wherein said elastomeric material is one of a flexible urethane material and a flexible silicone material.

13. The chair of claim 9, comprising a pair of said rigid members respectively embedded within said side portions of said seat.

14. The chair of claim 9, wherein said side portions of said seat are independently flexible with respect to one another between said first and second positions responsive to the weight of a seated user.

15. The chair of claim 9, wherein said flexible material occupies an area of said seat which is normally disposed beneath the ischium of a seated user.

16. The chair of claim 9, wherein said seat support structure includes a pair of uprights disposed on opposite sides of said seat, and a backrest pivotally connected to said uprights.

17. A chair, comprising:

seat support structure including a support member; and a seat supported by said seat support structure, said seat comprising:

a flexible central portion positioned upon and supported by said support member;

a pair of opposite flexible side portions, each said side portion including a rigid member embedded therein, said seat elastically movable between a first, unflexed position in which said seat has a generally flat shape and a second, flexed position in which said side portions of said seat are flexed downwardly about said support member to form a saddle shape.

18. The chair of claim 17, wherein said flexible central and side portions are made of an elastomeric material.

19. The chair of wherein said elastomeric material is one of a flexible urethane material and a flexible silicone material.

20. The chair of claim 17, wherein said flexible central portion occupies an area of said seat which is normally disposed beneath the ischium of seated a user.

21. The chair of claim 17, wherein said seat support structure includes a pair of uprights disposed on opposite sides of said seat, and a backrest pivotally connected to said uprights.

22. The chair of claim 17, wherein said side portions of said seat are independently flexible with respect to one another between said first and second positions responsive to the weight of a seated user.

23. A chair, comprising:

seat support structure including a support member; and a seat formed of a flexible material, comprising:

a pair of opposite rear side portions each connected to said seat support structure;

a pair of front side portions; and a front central portion disposed between said front side portions, said front central portion positioned upon and engaging said support member, said seat resiliently flexible responsive to the weight of a seated user between a first position in which said seat has a generally flat shape, and a second position in which said front side portions of said seat are flexed downwardly about said support member to form a saddle shape, said opposite front side portions of said seat independently flexible with respect to one another responsive to the weight of a seated user.

24. The chair of claim 23, wherein said flexible material is an elastomeric material.

25. The chair of claim 24, wherein said elastomeric material is one of a flexible urethane material and a flexible silicone material.

26. The chair of claim 23, wherein said seal further includes at least one rigid portion embedded within said flexible material.

27. The chair of claim 23, wherein said seat support structure includes a pair of uprights disposed on opposite sides of said seat, and a backrest pivotally connected to said uprights.

28. The chair of claim 1, wherein wherein said seat further comprises a rear portion including said rigid member, said rigid member including a cutout positioned in an area of said seat which is normally disposed beneath the ischium of a seated user, said flexible material at least partially filling said cutout.

29. The chair of claim 1, wherein said seat support structure comprises a flex lockout mechanism, said flex lockout mechanism, said flex lockout mechanism moveable between a first position in which said lockout mechanism prevents flexing of said seat and a second position in which said lockout mechanism permits flexing of said seat.

30. The chair of claim 1, wherein said seat support structure includes a caster wheel assembly having a height-adjustable pneumatic cylinder extending upwardly therefrom, said cylinder including an upper end operably supporting said seat.

31. The chair of claim 9, wherein said seat support structure comprises a flex lockout mechanism, said flex lockout mechanism moveable between a first position in which said lockout mechanism prevents flexing of said seat and a second position in which said lockout mechanism permits flexing of said seat.

32. The chair of claim 17, wherein said seat support structure comprises a flex lockout mechanism, said flex lockout mechanism moveable between a first position in which said lockout mechanism prevents flexing of said seat and a second position in which said lockout mechanism permits flexing of said seat.

33. The chair of claim 23, wherein said seat support structure comprises a flex lockout mechanism, said flex lockout mechanism moveable between a first position in which said lockout mechanism prevents flexing of said and a second position in which said lockout mechanism permits flexing of said seat.

* * * * *

UNITED STATES PATENT AND TRADEMARK OFFICE

CERTIFICATE OF CORRECTION

PATENT NO. : 6,811,218 B2
DATED : November 2, 2004
INVENTOR(S) : Michael L. Deimen et al.

It is certified that error appears in the above-identified patent and that said Letters Patent is hereby corrected as shown below:

Column 13,
Line 21, after "of" insert -- claim 17, --.

Column 14,
Line 6, delete "seal" and insert therefor -- seat --.

Signed and Sealed this

Fifteenth Day of March, 2005

JON W. DUDAS
*Director of the United States Patent and Trademark Office*